US010519916B1

(12) United States Patent
Coldren et al.

(10) Patent No.: US 10,519,916 B1
(45) Date of Patent: Dec. 31, 2019

(54) FLEXIBLE RATE SHAPE COMMON RAIL FUEL SYSTEM AND FUEL INJECTOR FOR SAME

(71) Applicant: Caterpillar Inc., Deerfield, IL (US)

(72) Inventors: Dana R. Coldren, Secor, IL (US); Sana Mahmood, Albuquerque, NM (US); Stephen R. Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 15 days.

(21) Appl. No.: 16/007,418

(22) Filed: Jun. 13, 2018

(51) Int. Cl.

| | |
|---|---|
| ***F02M 63/02*** | (2006.01) |
| ***F02M 51/00*** | (2006.01) |
| ***F02M 57/00*** | (2006.01) |
| ***F02M 61/18*** | (2006.01) |
| *F02M 67/12* | (2006.01) |

(52) U.S. Cl.
CPC ..... *F02M 63/028* (2013.01); *F02M 51/005* (2013.01); *F02M 57/005* (2013.01); *F02M 61/1806* (2013.01); *F02M 63/023* (2013.01); *F02M 63/0265* (2013.01); *F02M 67/12* (2013.01); *F02M 2200/247* (2013.01); *F02M 2547/008* (2013.01)

(58) Field of Classification Search
CPC ..... F02M 63/02; F02M 63/028; F02M 51/00; F02M 51/005; F02M 57/005; F02M 61/1806; F02M 63/023; F02M 63/0265; F02M 67/12; F02M 2200/247; F02M 2547/008
See application file for complete search history.

(56) References Cited

U.S. PATENT DOCUMENTS

| | | | | |
|---|---|---|---|---|
| 5,722,600 | A * | 3/1998 | Horiuchi | F02M 47/027 239/533.8 |
| 6,053,421 | A | 4/2000 | Chockley | |
| 6,634,339 | B2 | 10/2003 | He et al. | |
| 6,854,962 | B2 | 2/2005 | Spoolstra et al. | |
| 7,111,614 | B1 | 9/2006 | Coldren et al. | |
| 7,143,576 | B2 * | 12/2006 | Oono | F02D 41/3845 60/285 |
| 9,562,487 | B2 | 2/2017 | Shaver et al. | |

* cited by examiner

*Primary Examiner* — Hieu T Vo
(74) *Attorney, Agent, or Firm* — Jonathan F. Yates

(57) ABSTRACT

A fuel system for an internal combustion engine includes a common rail and a plurality of fuel injectors connected to the common rail and each including an outlet check, an injection control valve, and an injection rate controller. The injection rate controller varies a flow area to a nozzle of the fuel injector such that a pressure drop through the fuel injector is varied to provide injection rate shaping.

20 Claims, 7 Drawing Sheets

FLEXIBLE RATE SHAPE COMMON RAIL FUEL SYSTEM AND FUEL INJECTOR FOR SAME

TECHNICAL FIELD

The present disclosure relates generally to a common rail fuel system for an internal combustion engine and, more particularly, to injection rate shaping in a common rail fuel system.

BACKGROUND

A wide variety of fuel supply system are well known and widely used in modern internal combustion engines. In some instances, fuel is pressurized for injection by way of a so-called unit pump that can be mechanically actuated by way of an engine cam. The unit pumps are typically coupled with or part of individual fuel injectors, although designs are known where a single unit pump provides fuel pressurization for multiple injector units. Other fuel supply systems employ a common rail that stores a reservoir of pressurized fuel to be delivered to individual fuel injectors. Both general types of systems have certain advantages and disadvantages.

Mechanically actuated unit pumps or "unit injectors" commonly include a spill valve that can be opened and closed to vary the pressurization profile of fuel within the associated fuel injector. For example, a cam-actuated plunger in a unit injector can reciprocate to draw fuel into a plunger cavity when the spill valve is open and pressurize the fuel in the plunger cavity when the spill valve is closed. By varying the state of the spill valve the relative extent of pressurization and timing of pressurization of the fuel can be varied. An outlet check within the fuel injector which can be directly hydraulically controlled, or controlled based upon a pressure of fuel within the fuel injector, lifts to open spray orifices and enable injection of fuel. The rate of fuel injection can be varied in a relatively straightforward manner by selectively opening, closing, reopening, et cetera, the spill valve. Engineers have experimented with so-called injection rate shaping in unit injectors for many years.

Common rail fuel systems can present greater challenges to varying injection rate. Although timing and delivery can be changed from cycle to cycle, injection pressure generally cannot respond rapidly enough within an engine cycle for much rate shaping because injection pressure is tied to system volume and responsiveness of a high pressure common rail pump. In general, common rail injectors are limited to a single rate shape, which is typically a square injection profile at all delivery conditions.

It has been observed that varying rate shape can be desirable regardless of fuel system type in that combustion properties such as combustion efficiency and emissions profile can be advantageously manipulated if rate shape can be controlled. While some degree of rate shaping can be achieved with precise control of the outlet check in a common rail system, such an approach can undesirably affect spray characteristics of the exiting fuel. U.S. Pat. No. 7,111,614 is directed to a single fluid injector with rate shaping capability. In the '614 patent, rate shaping is accomplished by way of a valve operably coupled to an electrical actuator and movable between a high pressure seat and a low pressure seat. Movement of a needle valve for injection and movement of an admission valve for varying injection rate are both apparently accomplished by way of movement of a control valve member with an electrical actuator.

SUMMARY OF THE INVENTION

In one aspect, a fuel system for an internal combustion engine includes a fuel supply, a common rail, and a fuel pressurization pump structured to pressurize a fuel for supplying to the common rail. The fuel system further includes a plurality of fuel injectors each having formed therein a high pressure inlet fluidly connected to the common rail, a nozzle chamber fluidly connected to the high pressure inlet by way of a nozzle passage, a control chamber fluidly connected to the high pressure inlet, a plurality of spray orifices, and a low pressure outlet. Each of the plurality of fuel injectors further includes an outlet check movable to open and close the plurality of spray orifices to the nozzle chamber and having a closing hydraulic surface exposed to a fluid pressure of a control chamber, and an injection control valve movable to open and close the control chamber to the low pressure outlet. Each of the plurality of fuel injectors further includes an injection rate controller exposed to a flow of fuel through the nozzle passage, and adjustable between a rate limiting configuration, and a second configuration. A flow area of the nozzle passage is limited by the injection rate controller to a relatively greater extent at the rate limiting configuration, and the flow area is limited to a relatively lesser extent at the second configuration.

In another aspect, a fuel injector includes an injector body having formed therein a high pressure inlet structured to fluidly connect to a common rail, a nozzle chamber fluidly connected to the high pressure inlet, a control chamber fluidly connected to the high pressure inlet, a plurality of spray orifices, and a low pressure outlet. The injector body further has formed therein a nozzle passage that extends between the high pressure inlet and the nozzle chamber. The fuel injector further includes an outlet check movable to open and close the plurality of spray orifices to the nozzle chamber to inject a fuel supplied from the common rail into an engine cylinder and having a closing hydraulic surface exposed to a fluid pressure of the control chamber, and an injection control valve movable to open and close the control chamber to the low pressure outlet. Each of the plurality of fuel injectors further includes an injection rate controller exposed to a flow of fuel through the nozzle passage. The injection rate controller is in a rate limiting configuration where a flow area of the nozzle passage is limited by the injection rate controller to a relatively greater extent, and adjustable to a second configuration where the flow area of the nozzle passage is limited by the injection rate controller to a relatively lesser extent to reduce a pressure drop from the high pressure inlet to the nozzle chamber during the injection of fuel.

In still another aspect, a method of operating a pressurized fuel injection system includes conveying a pressurized fuel from a common rail into a fuel injector, and opening an outlet check in the fuel injector to start an injection of the pressurized fuel from the fuel injector into a cylinder in an internal combustion engine. The method further includes adjusting an injection rate controller within the fuel injector between a rate limiting configuration and a second configuration after the start of the injection of the pressurized fuel to vary a pressure drop through a nozzle passage of the fuel injector, and varying a rate of the injection of the fuel in response to the adjustment of the injection rate controller.

DETAILED DESCRIPTION

Figure 1:
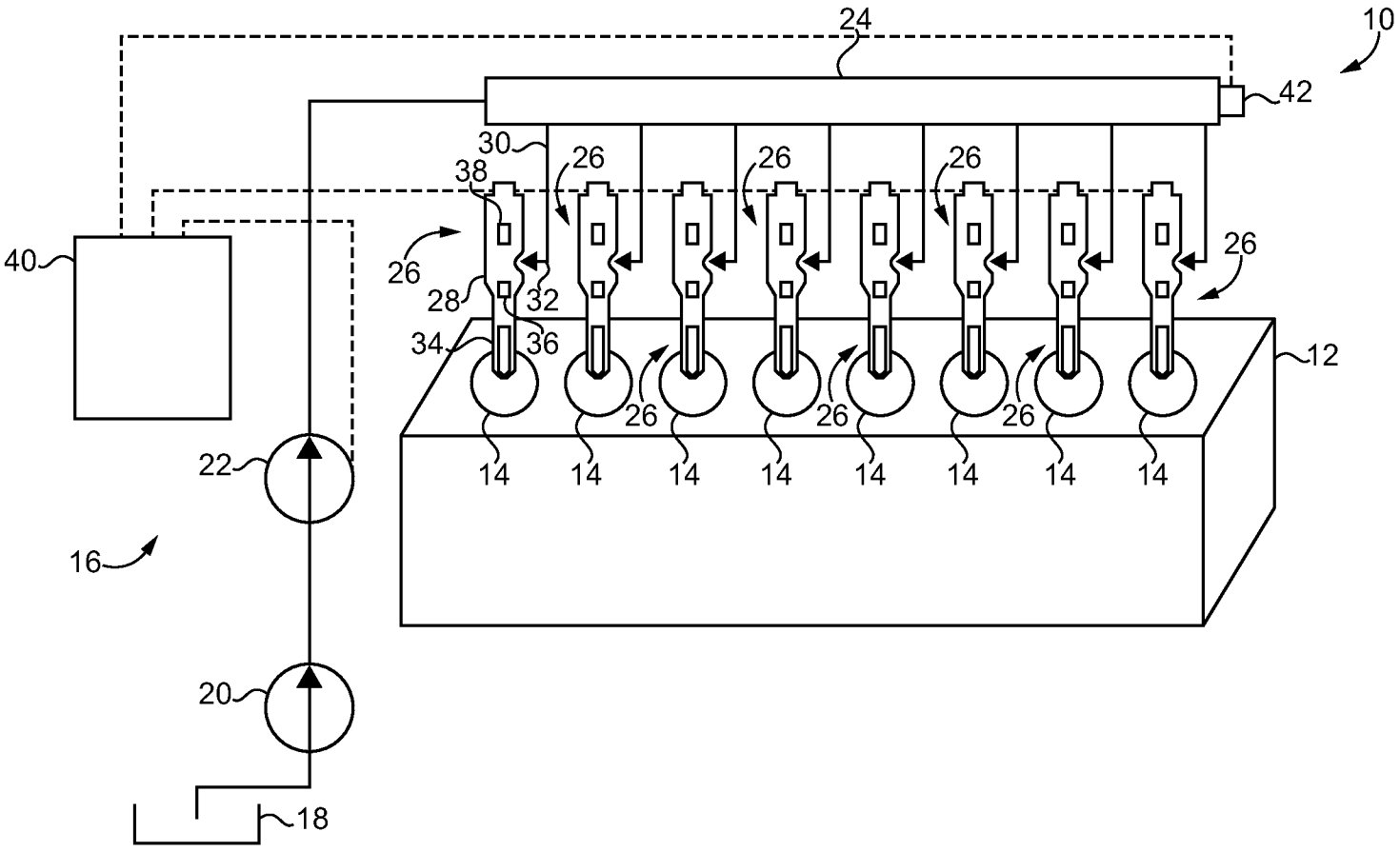
FIG. 1 is a diagrammatic view of an internal combustion engine having a fuel system, according to one embodiment.

Referring to FIG. 1, there is shown an internal combustion engine 10, according to one embodiment. Internal combustion engine 10 (hereinafter "engine 10") may include a compression ignition diesel engine structured to operate on a diesel distillate fuel or the like as a single fuel engine, however, other fuel types and/or dual fuel configurations are within the scope of the present disclosure. Engine 10 includes an engine housing 12 having a plurality of combustion cylinders 14 formed therein and arranged in an in-line configuration, a V-configuration, or in any other suitable arrangement. Engine 10 also includes a fuel system 16 having a fuel supply 18, and a fuel transfer pump 20 fluidly connected with fuel supply 18. A high pressure pump 22 is positioned fluidly between fuel transfer pump 20 and a common rail 24, and is structured to pressurize a fuel for supplying to common rail 24. Pump 22 can include a cam-driven inlet metered pump in one embodiment, but could include an electrically powered pump, an outlet metered pump, or another type of pump in other embodiments. A plurality of fuel supply conduits 30 are connected to common rail 24 and structured to supply pressurized fuel stored from common rail 24 to each one of a plurality of fuel injectors 26. A plurality of connectors, such as so-called quill connectors 32, may be arranged to supply the pressurized fuel from fluid supply conduits 30 to each one of fuel injectors 26. Fuel injectors 26 can each be positioned within a cylinder head (not shown) and extend partially into one of cylinders 14. It should be appreciated that common rail 24 could include a single-piece monolithic body having one pressure reservoir formed therein but could instead include a plurality of separate high pressure, double walled conduits connecting between individual fuel injectors 26 in a so-called daisy chain arrangement or the like. In still other instances multiple common rails could be provided for supplying fuel to separate cylinder banks in engine 10. Each of fuel injectors 26 includes an injector body 28, and an outlet check 34 movable within injector body 28 to control an injection of fuel into the corresponding one of cylinders 14. Each fuel injector 26 further includes an injection control valve or valve assembly 36 and an injection rate controller 38. Those skilled in the art will be familiar with challenges associated with controlling injection rate to desired effect in certain fuel systems, including common rail fuel systems. As will be further apparent from the following description, fuel system 16 is uniquely configured for injection rate control and shaping in a common rail fuel system. It should also be appreciated that descriptions herein of any fuel injector 26 or fuel injector component in the singular should be understood to refer by way of analogy to any of the other fuel injectors in fuel system 16. Moreover, discussion of any one embodiment and components of any one embodiment should be understood to refer to analogously configured components in any other embodiment contemplated herein.

Figure 2:
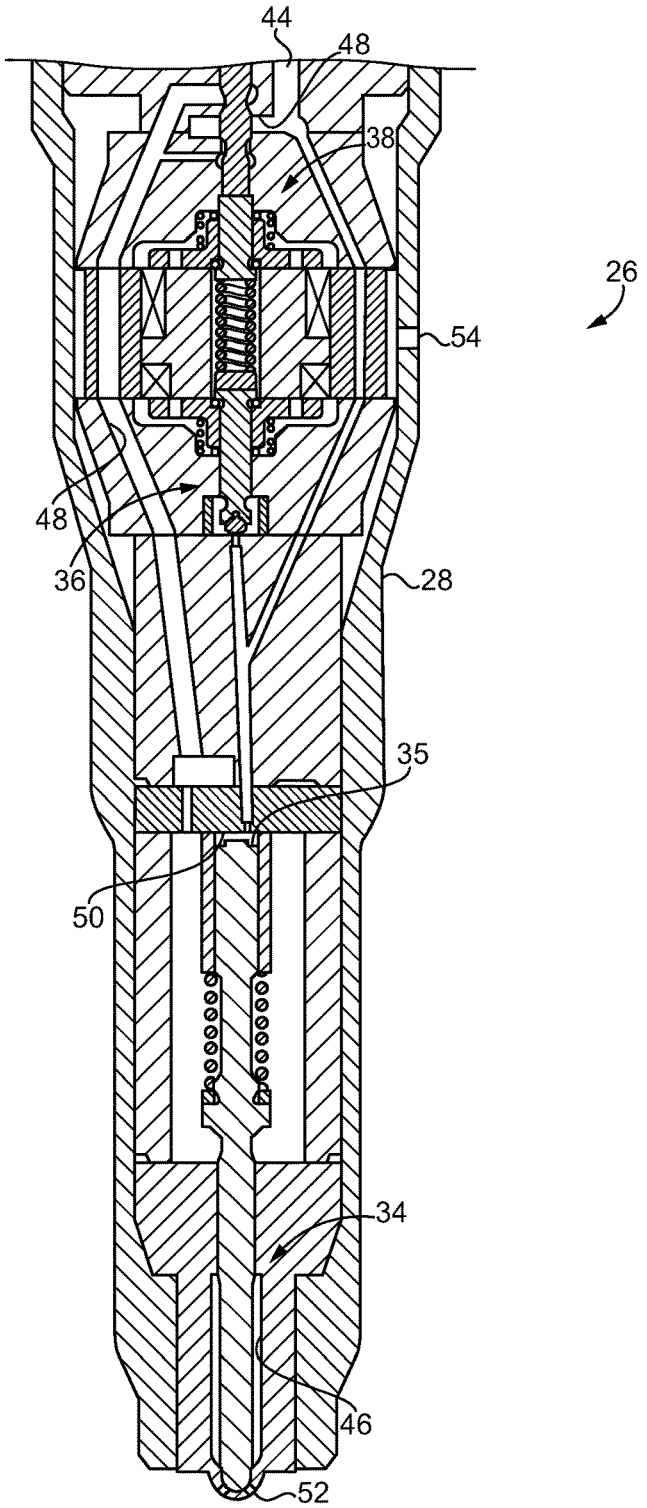
FIG. 2 is a sectioned side diagrammatic view of a portion of a fuel injector, according to one embodiment.

Referring also now to FIG. 2, there is shown one of fuel injectors 26 in greater detail. Fuel injector 26 has formed therein a high pressure inlet 44 fluidly connected to common rail 24. High pressure inlet 44 is formed in injector body 28 of fuel injector 26 and could be arranged at a variety of locations. High pressure inlet 44 could be a port or a passage in an exterior of injector body 28 connected with one of connectors 32 to provide a high pressure seal as is generally known in the art. High pressure inlet 44 could be an inlet from one component in fuel injector 26 to another component in fuel injector 26. A nozzle chamber 46 is also formed in injector body 28 and fluidly connected to high pressure inlet 44 by way of a nozzle passage 48. A control passage 49 also is fluidly connected with high pressure inlet 44, as further discussed herein. A control chamber 50 is also fluidly connected to high pressure inlet 44. Injector body 28 further has formed therein a variety of spray orifices 52, and a low pressure outlet 54. Outlet check 34 is movable within injector body 28 to open and close spray orifices 52 to nozzle chamber 46 to control starting and stopping of injection of fuel into the associated engine cylinder 14. Outlet check 34 includes a closing hydraulic surface 35 exposed to a fluid pressure of control chamber 50. Injection control valve 36 is movable to open and close control chamber 50 to low pressure outlet 54. It can be noted from FIG. 2 that fuel injector 26 provides a first path for high pressure fuel from high pressure inlet 44 to nozzle chamber 46 for injection, and a second path for high pressure fuel from high pressure inlet 44 to control chamber 50 for directly controlling outlet check 34.

As noted above, fuel injector 26 also includes an injection rate controller 38. Injection rate controller 38 is exposed to a flow of fuel through nozzle passage 48, and adjustable between a rate limiting configuration, and a second configuration. A flow area of nozzle passage 48 is limited by injection rate controller 38 to a relatively greater extent at the rate limiting configuration, and the flow area is limited to a relatively lesser extent at the second configuration. At each of the rate limiting configuration and the second configuration nozzle passage 48 may be open to high pressure inlet 44. It has been observed that a pressure drop between high pressure inlet 44 and nozzle chamber 46, and in particular a pressure drop from injection rate controller 38 to nozzle chamber 46 can be affected by varying flow area of nozzle passage 48. Pressure drop can in turn affect fuel injection rate and, accordingly, rate shaping during a fuel injection can be effected by way of the variable flow area strategy disclosed herein. As further discussed below injection rate controllers according to the present disclosure can have various forms.

Figure 3:
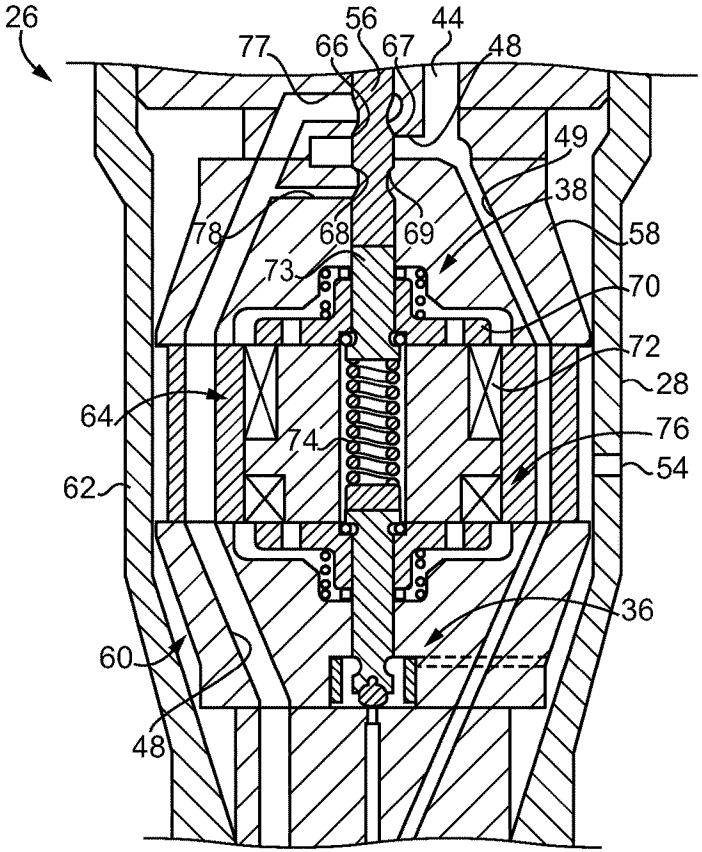
FIG. 3 is a sectioned side diagrammatic view showing a portion of the fuel injector of FIG. 2 enlarged.

Referring also now to FIG. 3, there are shown parts of fuel injector 26 in greater detail. In the illustrated embodiment injector body 28 includes a valve stack 60 positioned within a case 62. Injection rate controller 38 includes an assembly of a rate control valve 56 and at least one body piece 58 which includes one of a plurality of body pieces forming stack 60. Injection rate controller 38 further includes an electrical actuator 64 structured to move rate control valve 56 within the at least one body piece 58 (hereinafter "body piece 58") between a first position and a second position corresponding, respectively, to the rate limiting configuration and the second configuration. Rate control valve 56 may include a three-way poppet valve attached, in the embodiment of FIG. 3, to a rod 73 in turn attached to an armature 70 of electrical actuator 64. Energizing and deenergizing a solenoid 72 of electrical actuator 64 causes armature 70, rod 73, and rate control valve 56 to move toward solenoid 72. At a first position of rate control valve 56 a sealing surface 67 of rate control valve 56 contacts and seals with a first seat 66, and at a second position a second sealing surface 69 contacts and seals with a second seat 68. Sealing surfaces 67 and 69, and seats 66 and 68, may be conical. First seat 66 fluidly connects to a high flow rate branch 77 of nozzle passage 48. Second seat 68 fluidly connects to a low flow rate branch 78 of nozzle passage 48. A biaser 74, such as a coil spring biaser, biases rate control valve 56 to the first position blocking first seat 66. It can therefore be appreciated that a deenergized state of electrical actuator 64 is associated with the relatively smaller flow area of nozzle passage 48, and upon energizing solenoid 72 rate control valve 56 moves to its second position to establish the relatively greater flow area of nozzle passage 48 associated with the second configuration of injection rate controller 38. It should be appreciated that designs are contemplated where electrical actuator 64 could be energized to position rate control valve 56 to provide the relatively smaller flow area of nozzle passage 48, and de-energized to position establish the relatively greater flow area of nozzle passage 48. A second electrical actuator 76 is associated with injection control valve 36 which operates in a generally conventional manner to vary control pressure in control chamber 50 and control a start-of-injection timing and an end-of-injection timing. Energizing and deenergizing electrical actuator 64 can control an injection rate between the start of injection and end of injection for purposes of greater efficiency, reduced emissions of certain types, and potentially for other purposes such as improved cold start. Also in a practical implementation strategy pressurized fuel can leak through a guide clearance (not numbered) formed between rate control valve 56 and body piece 58.

Figure 4:
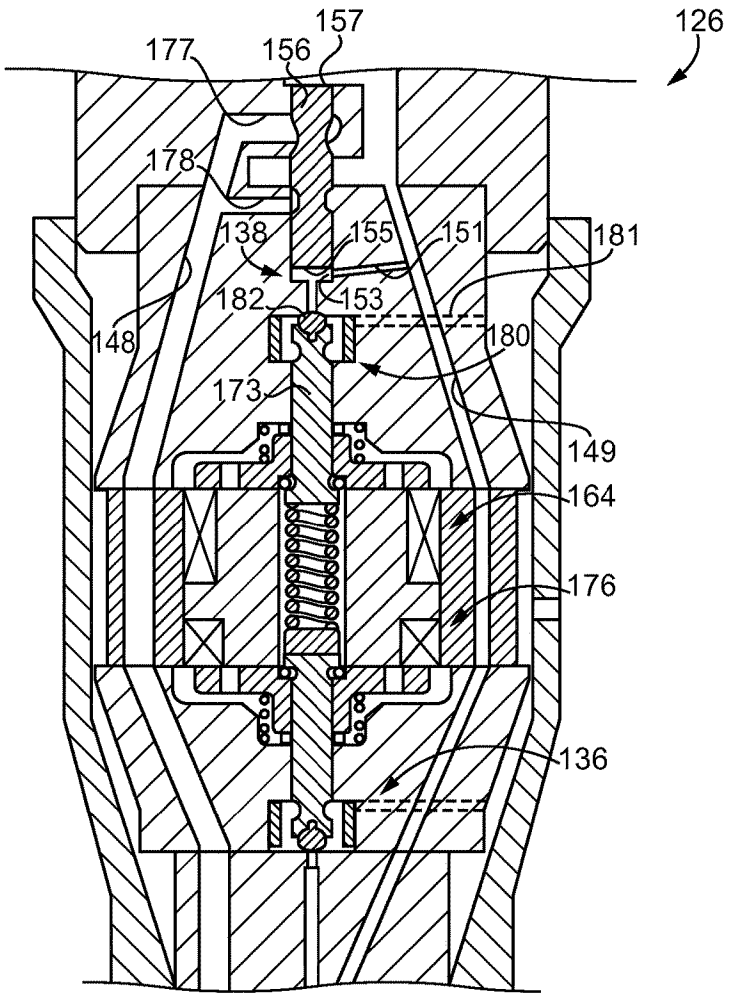
FIG. 4 is a sectioned side diagrammatic view of a portion of a fuel injector, according to another embodiment.

Turning now to FIG. 4, there is shown part of a fuel injector 126, according to another embodiment. Fuel injector 126 has certain similarities with fuel injector 26 and therefore descriptions above of fuel injector 26 will be understood to refer by way of analogy to fuel injector 126. Fuel injector 126 has certain differences from the preceding embodiment, however. Fuel injector 126 includes an injection control valve/control valve assembly 136 including an electrical actuator 176. Another electrical actuator 164 is associated with another control valve assembly 180 associated with an injection rate controller 138. A nozzle passage 148 includes a high flow rate branch 177 and a low flow rate branch 178 which are opened and closed by way of a rate control valve 156, which can include a three-way poppet valve. Rate control valve 156 includes a control surface 155 at a first end thereof, and a control surface 157 at an opposite end thereof. Each of control surface 155 and control surface 157 can be exposed to high pressure from a high pressure inlet (not numbered). Fuel injector 126 further has formed therein a control chamber 153 that includes a fluid passage 151 connecting to a control passage 149. Control passage 149 can communicate with a check control chamber (not shown in FIG. 4) in a manner analogous to the preceding embodiment of fuel injector 26. Rather than a rate control valve 56,156,256 attached directly to components of an electrical actuator 64, control valve assembly 180 is fluidically coupled to rate control valve 156 and structured to move a valve member 182 to open and block control chamber 153 to a low pressure outlet of fuel injector 126. Control valve assembly 180 can be biased closed. In one implementation control surfaces 155 and 157 are appropriately sized and/or passages feeding fluid to control surfaces 155 and 157 appropriately sized such that rate control valve 156 will be biased to a position where rate control valve 156 blocks high flow rate branch 177 and low flow rate branch 178 is open. Operating control valve assembly 180 can rapidly reduce hydraulic pressure acting upon control surface 155 to enable high pressure acting on control surface 157 to cause rate control valve 156 to move to a second position blocking low flow rate passage 178 and opening high flow rate passage 177. Valve seats and sealing surfaces may be provided in fuel injector 126 in a manner generally analogous to those in fuel injector 26. In some embodiments, a biasing spring might be provided to assist in biasing rate control valve 156 toward the first position blocking high flow rate passage 177.

Figure 5:
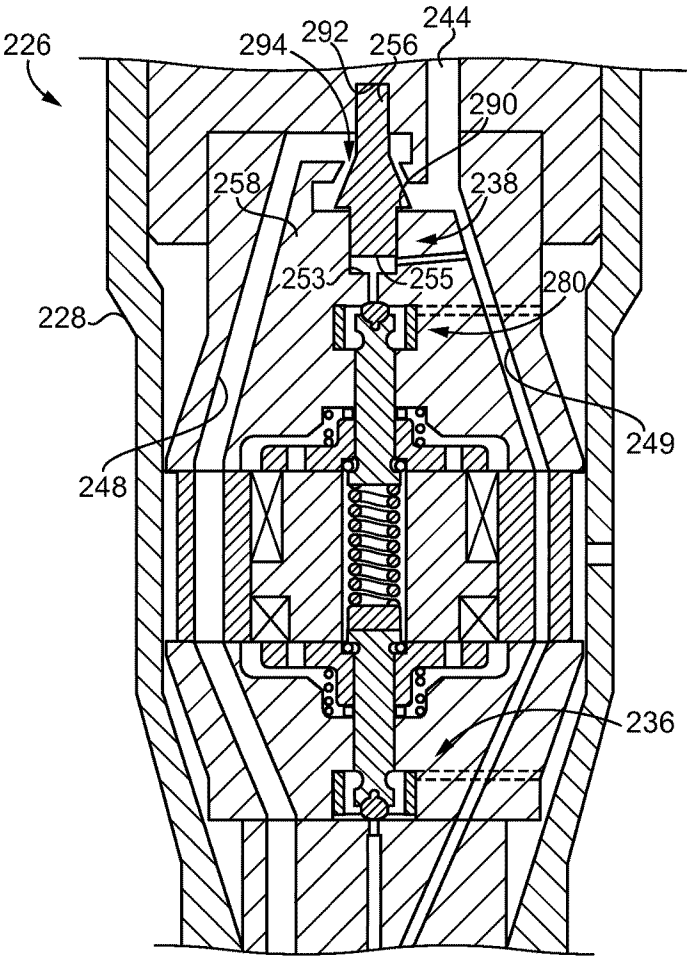
FIG. 5 is a sectioned side diagrammatic view of a portion of a fuel injector, according to yet another embodiment.

Turning now to FIG. 5, there is shown a fuel injector 226 according to yet another embodiment, and including an injector body 228, and an injection control valve 236 positioned therein. Injection control valve 236 will function in a manner generally analogous to the other injection control valves described herein. A nozzle passage 248 extends between a high pressure inlet 244 and a nozzle chamber not visible in FIG. 5. A control passage 249 extends between high pressure inlet 244 and a control chamber not visible in FIG. 5. A second control valve assembly 280 is part of an injection rate controller 238. Injection rate controller 238 includes a rate control valve 256 movable between a first stop position contacting a first stop surface 292 and a second stop position contacting a second stop surface 290. A clearance 294 extends around rate control valve 256. By moving rate control valve 256 between the first stop position and the second stop position, a size of clearance 294 is adjusted to vary a flow area of nozzle passage 248 in a manner that provides variation in injection rate consistent with operating principles of the other embodiments discussed herein. Rather than a high flow branch and a low flow branch of a nozzle passage 248, however, in fuel injector 226 the position of rate control valve 256 within the same part of nozzle passage 248 provides the variation in pressure drop from high pressure inlet 244 to the associated nozzle chamber 46. A control chamber 253 is also formed in injector body 228 and provides a control pressure applied to a control surface 255 of rate control valve 256. Control valve assembly 280 may be biased toward a closed position, with high pressure being normally supplied to control chamber 253, thereby biasing rate control valve 256 to contact first stop surface 292. When control valve assembly 280 is actuated open, pressure in control chamber 253 can drop, enabling rate control valve 256 to move down to contact stop surface 290. Moving rate control valve 256 from the first stop position to the second stop position adjusts injection rate controller 238 from its rate limiting configuration to its second configuration, and enlarges the size of clearance 294.

Figure 6:
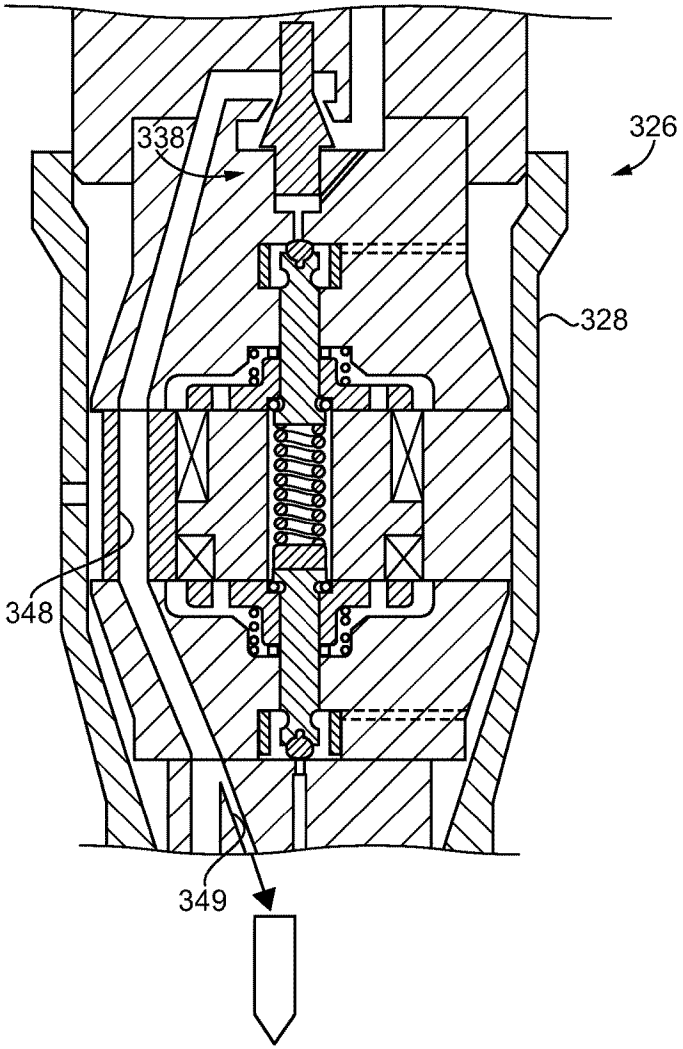
FIG. 6 is a sectioned side diagrammatic view of a portion of a fuel injector, according to yet another embodiment.

Turning to FIG. 6, there is shown another fuel injector 326 according to another embodiment and having a number of similarities with fuel injector 226, but with certain differences. Fuel injector 326 includes an injector body 328, an outlet check 334, and an injection rate controller 338 which can be configured substantially identically to injection rate controller 238 discussed above. Fuel injector 326 also includes a nozzle passage 348, which instead of feeding only a nozzle chamber 46 for fuel injection, divides into a branch passage 349 that serves as a control passage for check control using pressure downstream of injection rate controller 338 instead of rail pressure.

Figure 7:
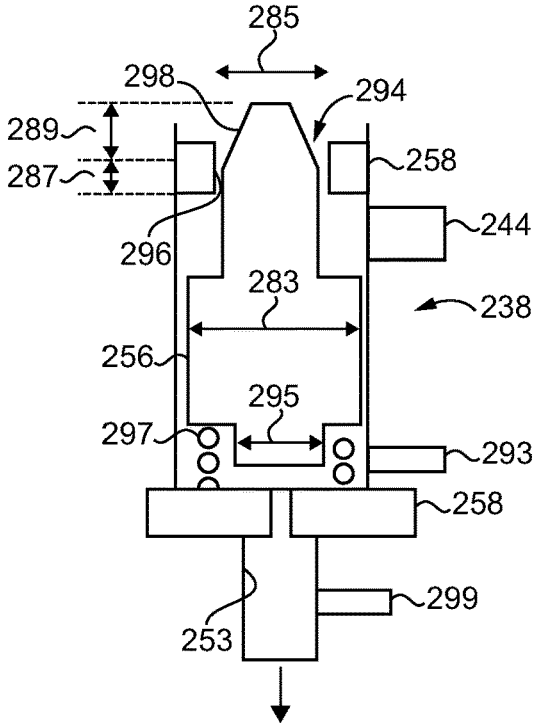
FIG. 7 is a concept diagram of parts of an injection rate controller, according to one embodiment.

Referring now to FIG. 7, there is shown a concept diagram of injection rate controller 238 components similar to those shown in the embodiment of FIG. 5, and using some of the same reference numerals, but with additional illustrative features and details. Injection rate controller 238 includes rate control valve 256, shown as it might appear positioned in proximity to a body piece 258 of fuel injector 226 forming a metering edge 296. Rate control valve 256 includes an outer surface 298 that moves relative to metering edge 296 to vary a size of clearance 294. In one implementation outer surface 298 is conical and metering edge 296 is formed by an inside surface of a cylindrical bore. In other embodiments outer surface 298 might have a different shape, such as a cylindrical shape, and metering edge 296 could have a conical shape. In such an embodiment, a "metering edge" could be understood as part of rate control valve 256. Other configurations could be provided, with both of body piece 258 and rate control valve 256 having conical surfaces, one of those components having a conical surface and the other having a cylindrical surface, one or both having spherical surfaces, or still other arrangements. The present disclosure contemplates any geometry of body piece 258 and rate control valve 256 that enable varying of a flow area consistent with the purposes of the present disclosure. It is generally desirable is to provide a relatively large change in the size of clearance 294 in response to a relatively modest varying of the position of rate control valve 256.

In FIG. 7, a biaser is shown at 297 and could bias rate control valve 256 toward its first stop position where a minimum flow area is provided by clearance 294. Biaser 297 might alternatively be configured to bias rate control valve 256 toward a stop position where a maximum flow area is provided by clearance 294. The minimum flow area could be provided where clearance 294 is about 100 microns or 0.1 millimeters, between rate control valve 256 and an inside surface of metering edge 296. Rate control valve 256 might have a first body diameter 295 that is about 1.5 millimeters, and a second body diameter 283 that is about 3.0 millimeters. A diameter 285 at metering edge 296 might be about 2.8 millimeters. A first travel distance 287 of rate control valve 256, downward in FIG. 7, adjusts rate control valve 256 to a state at which additional downward adjustment varies flow area. In other words, for an initial part of the valve travel, no change in a size of clearance 294 occurs due to the constant shape of rate control valve 256 that is adjacent to metering edge 296. After moving travel distance 287, which might be about 200 microns or 0.2 millimeters, further travel of rate control valve 256 varies clearance 294. Total travel distance may be approximately 400 microns or 0.4 millimeters, shown in reference to a terminal tip of rate control valve 256 via numeral 289 in FIG. 7. The high pressure inlet is shown at 244 in FIG. 7. Another high pressure communication orifice is shown at 293. Yet another orifice is shown at 281, which will typically be smaller than orifice 293. Still another orifice connecting to high pressure is shown at 299.

Figure 8:
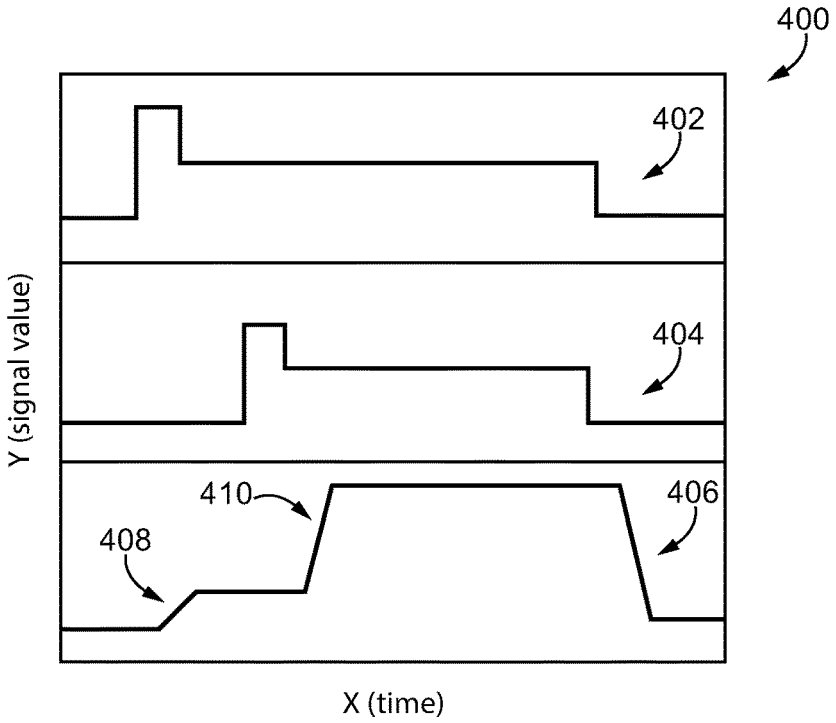
FIG. 8 is a graph illustrating injection rate and control valve waveforms, according to one embodiment.

Referring also now to FIG. 8, there is shown a graph 400 illustrating example traces for a check control valve waveform at 402, for a rate control valve waveform at 404, and an injection rate at 406. It can be noted that check control valve waveform 402 shows an initial energization that corresponds to what might be observed where fuel injection is commenced with the associated rate control valve 56,156, 256 at its biased position providing the relatively limited flow area of the associated nozzle passage. Injection rate 406 shows a toe at 408 illustrating what might be observed for an initial relatively low rate of fuel injection. After initial energization of the check control valve actuator, rate control valve waveform 404 shows energization after the start of fuel injection at a relatively lower injection rate. With the rate control valve 56,156,256 energized the variable flow area through the associated nozzle passage will increase, producing a main or increased part of the fuel injection shown at 410. Those skilled in the art will appreciate that other injection rate profiles might be provided depending upon the relative change, or lack of change, in nozzle passage flow rate, selected surface shapes, rate control valve 56 travel distance and speed, and potentially still other factors.

Figure 9:
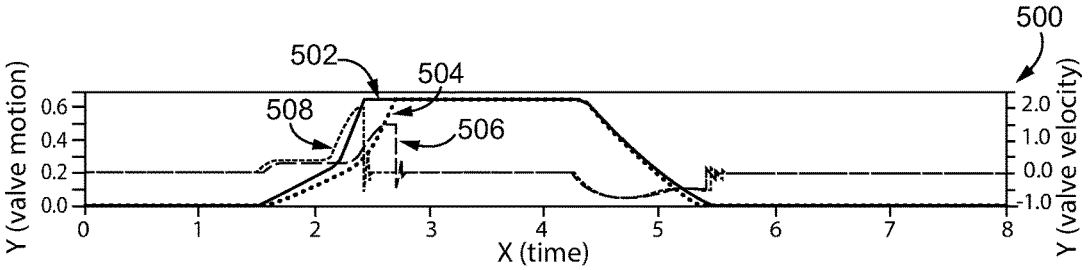
FIG. 9 is a graph illustrating valve motion and velocity over time.

Referring now to FIG. 9, there is shown a graph 500 with time on the X-axis, illustrating rate control valve 56 motion on the left Y-axis, and rate control valve 56 velocity illustrated on the right Y-axis, for a case 62 where a fuel injection generally similar to the fuel injection depicted at FIG. 8 is performed. At a trace 502 is shown an injection run at a relatively higher rail pressure, for example, about 160 MegaPascals (MPa). At a trace 504 is shown another run with rail pressure at about 100 MPa. At a trace 506 is shown valve velocity at the injection run at 100 MPa, and at a trace 508 is shown valve velocity at the injection run at 160 MPa. Other operating factors can be assumed generally consistent between the runs. It can be noted that rate control valve 56 velocity is greater at the higher pressure. Both rate control valve 56 position and rate control valve 56 velocity are shifted earlier in time for the higher pressure case 62 than for the lower pressure case 62.

Figure 10:
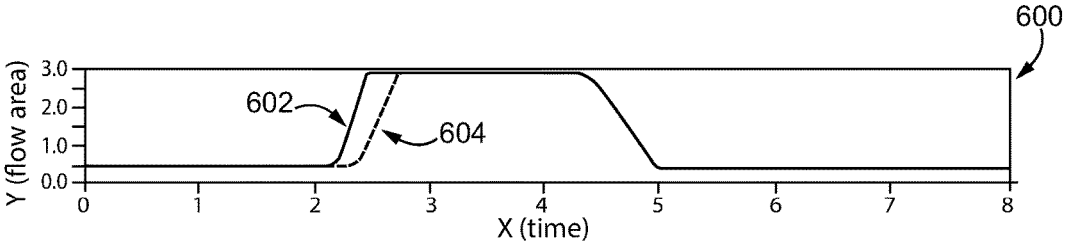
FIG. 10 is a graph illustrating valve flow area over time.
Figure 11:
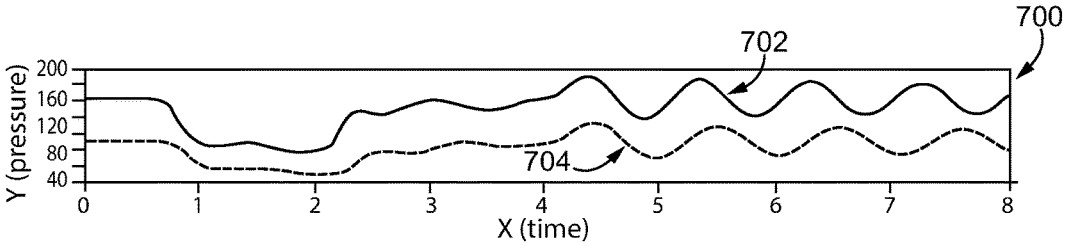
FIG. 11 is a graph illustrating pressure between a valve and check seat in a fuel injector over time.
Figure 12:
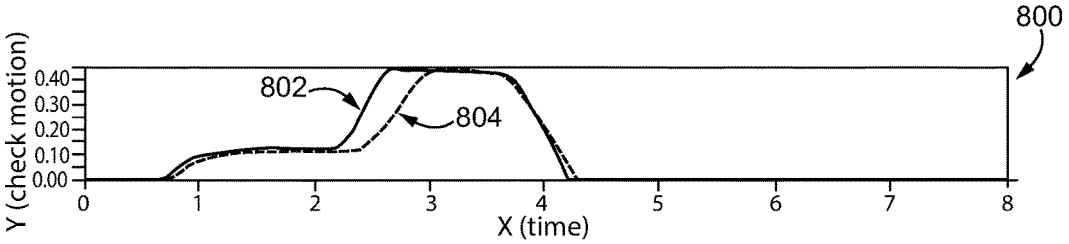
FIG. 12 is a graph illustrating check motion over time.
Figure 13:
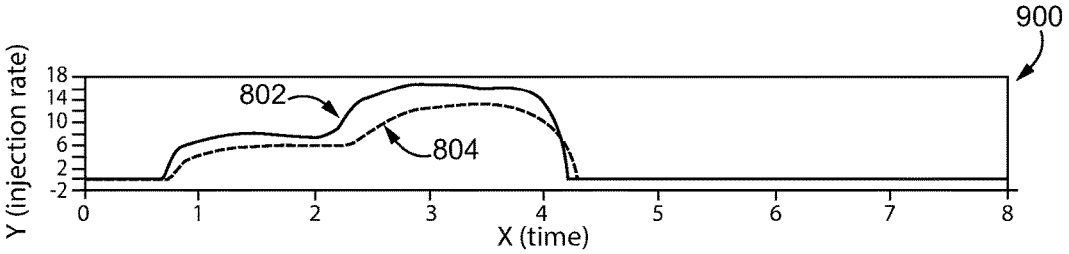
FIG. 13 is a graph illustrating injection rate over time.
Figure 14:
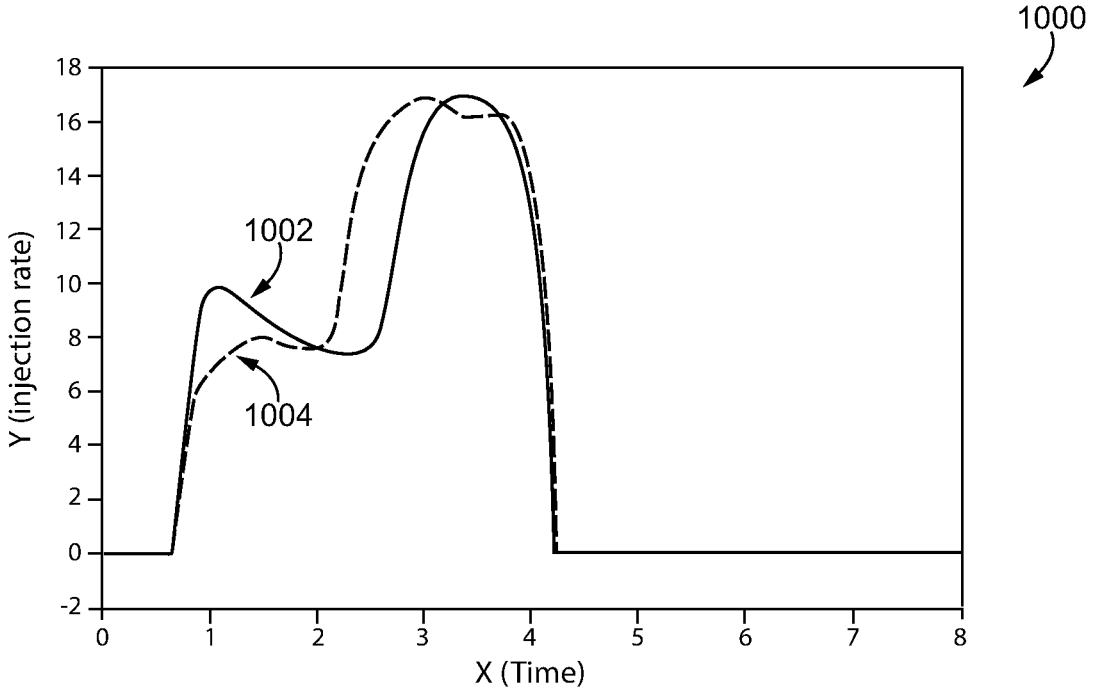
FIG. 14 is another graph illustrating injection rate over time.

FIG. 10 shows a graph 600 relating flow area of a rate control valve 56 on the Y-axis to time on the X-axis, for the same runs as those depicted in FIG. 9. It can be noted that valve flow area begins to change earlier, and changes more rapidly, in a higher pressure run shown by way of trace 602 than in a lower pressure run shown by way of trace 604. In a graph 700 at FIG. 11 is shown pressure between the rate control valve 56 and the outlet check seat for the same runs as those depicted in FIGS. 9 and 10, including a lower rail pressure injection run at 704 and a higher pressure injection run at 702. FIG. 12 illustrates a graph 800 where outlet check motion is shown on the Y-axis in relation to time on the X-axis for those same higher pressure and lower pressure runs at a trace 802 and at a trace 804, respectively. In FIG. 13 injection rate is shown on the Y-axis in relation to time on the X-axis for the lower pressure injection run at a trace 904 and for the higher pressure injection run at a trace 902. A two-phase, toe and main injection profile is evident in each case 62. FIG. 14 illustrates a graph 1000 showing injection rate on the Y-axis in relation to time on the X-axis, for an injection run 1002 where a fluid volume between a rate control valve 56 and an outlet check seat is relatively larger, in comparison to an injection run 1004 where a fluid volume between a rate control valve 56 and the injection seat is relatively smaller at a trace 1004. The larger volume associated with trace 1002 is associated with an initial rapid increase in injection rate, followed by a reduction in injection rate, and then a later increase as the rate control valve 56,156,265 is actuated to increase nozzle passage flow area. The lesser volume associated with trace 1004 demonstrates a generally smoother increase, less decrease, and earlier and more responsive increase for a main part of the injection when the rate control valve 56,156,256 is actuated. It can be appreciated in view of FIG. 14 that a relatively smaller volume between a rate control valve 56,156,256 and outlet check may provide desirably more stable results. As mentioned above, however, attempting to vary injection rate by manipulating flow too close to spray orifices 52 may have its own undesirable effects. In view of FIGS. 9-14 more generally, some of the effects of varying rail pressure on injection rate, rate control valve 56,156,256 and outlet check travel, and still other properties can be further appreciated.

INDUSTRIAL APPLICABILITY

Referring to the drawings generally, but in particular now back to FIG. 1, when engine 10 is running low pressure transfer pump 20 can operate to transfer fuel from fuel supply 18 to high pressure pump 22. High pressure pump 22 can pressurize fuel to be supplied to common rail 24. A pressure sensor 42 can be coupled with common rail 24 and provide pressure data to an electronic control unit 40. Electronic control unit 40 is in control communication with each one of fuel injectors 26 and also with high pressure pump 22 such that pump inlet or outlet metering can be varied, for example. Each of engine cylinders 14 will be equipped with a piston (not shown) that reciprocates to rotate a crankshaft.

In a typical four-cycle operating scheme each of the pistons within cylinders 14 will be moved in an intake stroke, a compression stroke, an expansion stroke, and an exhaust stroke in a generally conventional manner. Air, typically air pressurized by way of a turbocharger, is fed into each cylinder 14 during the intake stroke. Prior to, at, or after a piston reaches a top dead center position in one of cylinders 14, electronic control unit 40 can send an appropriate control command, such as an electrical current command, to the corresponding electrical actuator 76 in the one of fuel injectors 26 by way of which fuel injection is desired. Within each fuel injector 26 rail pressure may be supplied to the corresponding high pressure inlet 44, and nozzle chamber 46. The rate control valve 56 of the injection rate controller 38 in that fuel injector 26 will typically be in the biased position, such that a flow area through the corresponding nozzle passage 48 is the lesser of two available flow areas.

When injection control valve/valve assembly 36 receives the appropriate command, outlet check 34 can open to start fuel injection through spray orifices 52. With rate control valve 56 biased toward the rate limiting configuration, an initial fuel injection rate will be the lesser of the two available fuel injection rates. At the start of injection the injection rate profile might therefore look something like the toe portion 408 of trace 406 in FIG. 8. When it is desirable to increase fuel injection rate, electronic control unit 40 can output an appropriate control command to the associated injection rate controller 38 to commence moving rate control valve 56 to its second configuration where flow area through nozzle passage 48 is limited to a relatively lesser extent. With the increased flow area, the main part 410 of the injection profile as in trace 406 of FIG. 8 may begin. When it is desirable to end fuel injection, electronic control unit 40 can close injection control valve/valve assembly 36, and outlet check 34 will move to its closed position to terminate the fuel injection.

It should be appreciated that the other embodiments described herein can operate in a generally analogous fashion. It should also be appreciated that the injection rate profile depicted in FIG. 8 is exemplary only as discussed above. The timing of transitioning from a lower injection rate to a higher injection rate could be varied from that shown. Moreover, embodiments are contemplated where only a single injection rate is used in a given fuel injection. For instance, in certain operating schemes or certain conditions, rate control valve 56 might not be operated at all, with the injection taking place only with the lesser flow area through the nozzle passage. In others, rate control valve 56 might be positioned to provide the greater nozzle passage flow area throughout the entirety of the injection.

The present description is for illustrative purposes only, and should not be construed to narrow the breadth of the present disclosure in any way. Thus, those skilled in the art will appreciate that various modifications aright be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having" or the like are intended to be open-ended terms. Further, the phrase "based on" is intended to mean "based, at least in part, on" unless explicitly stated otherwise.

What is claimed is:

1. A fuel system for an internal combustion engine comprising:

a fuel supply;

a common rail;

a fuel pressurization pump structured to pressurize a fuel for supplying to the common rail; and a plurality of fuel injectors each having formed therein a high pressure inlet fluidly connected to the common rail, a nozzle chamber fluidly connected to the high pressure inlet by way of a nozzle passage, a control chamber fluidly connected to the high pressure inlet, a plurality of spray orifices, and a low pressure outlet;

each of the plurality of fuel injectors further including an outlet check movable to open and close the plurality of spray orifices to the nozzle chamber and having a closing hydraulic surface exposed to a fluid pressure of the control chamber, and an injection control valve movable to open and close the control chamber to the low pressure outlet;

each of the plurality of fuel injectors further including an injection rate controller exposed to a flow of fuel through the nozzle passage, and adjustable between a rate limiting configuration, and a second configuration; and a flow area of the nozzle passage is limited by the injection rate controller to a relatively greater extent at the rate limiting configuration, and the flow area is limited to a relatively lesser extent at the second configuration.

2. The fuel system of claim 1 wherein the injection rate controller includes an assembly of a rate control valve and at least one body piece.

3. The fuel system of claim 2 wherein the injection rate controller further includes an electrical actuator structured to move the rate control valve within the at least one body piece between a first position and a second position corresponding, respectively, to the rate limiting configuration and the second configuration.

4. The fuel system of claim 3 wherein each of the fuel injectors further has formed therein a second control chamber and the rate control valve includes a control surface exposed to the second control chamber.

5. The fuel system of claim 4 wherein the injection rate controller further includes a control valve assembly coupled with the electrical actuator and adjustable to open and block the second control chamber to the low pressure outlet.

6. The fuel system of claim 4 wherein the control valve assembly further includes a biaser biasing the control valve assembly to a closed state where the second control chamber is blocked to the low pressure outlet.

7. The fuel system of claim 3 wherein the at least one body piece has formed therein a first valve seat connected to a higher flow branch of the nozzle passage, and a second valve seat connected to a restricted flow branch of the nozzle passage.

8. The fuel system of claim 7 wherein the rate control valve includes a three-way valve having a first sealing surface in contact with the first valve seat at the first position, and a second sealing surface in contact with the second valve seat at the second position.

9. The fuel system of claim 3 wherein the at least one body piece includes a metering edge, and the rate control valve has an outer surface movable relative to the metering edge to vary the flow area through the nozzle passage.

10. The fuel system of claim 9 wherein the outer surface has a conical shape, and the rate control valve is movable between a first stop position where a relatively smaller clearance extends between the metering edge and the outer surface, and a second stop position where a relatively larger clearance extends between the metering edge and the outer surface.

11. A fuel injector comprising:

an injector body having formed therein a high pressure inlet structured to fluidly connect to a common rail, a nozzle chamber fluidly connected to the high pressure inlet, a control chamber fluidly connected to the high pressure inlet, a plurality of spray orifices, and a low pressure outlet;

the injector body further having formed therein a nozzle passage that extends between the high pressure inlet and the nozzle chamber;

an outlet check movable to open and close the plurality of spray orifices to the nozzle chamber to inject a fuel supplied from the common rail into an engine cylinder and having a closing hydraulic surface exposed to a fluid pressure of the control chamber, and an injection control valve movable to open and close the control chamber to the low pressure outlet;

each of the plurality of fuel injectors further including an injection rate controller exposed to a flow of fuel through the nozzle passage;

the injection rate controller is in a rate limiting configuration where a flow area of the nozzle passage is limited by the injection rate controller to a relatively greater extent, and adjustable to a second configuration where the flow area of the nozzle passage is limited by the injection rate controller to a relatively lesser extent to reduce a pressure drop from the high pressure inlet to the nozzle chamber during the injection of fuel.

12. The fuel injector of claim 11 wherein the injection rate controller includes a rate control valve and an electrical actuator structured to move the rate control valve between a first position and a second position corresponding, respectively, to the rate limiting configuration and the second configuration.

13. The fuel injector of claim 12 wherein the nozzle passage includes a higher flow branch, and a lower flow branch, and the rate control valve includes a three-way valve fluidly connecting the high pressure inlet to the nozzle chamber by way of the lower flow branch at the first position and by way of the higher flow branch at the second position.

14. The fuel injector of claim 13 wherein the injection rate controller includes a biaser biasing the rate control valve toward the first position.

15. The fuel injector of claim 13 wherein:

the injector body further has formed therein a second control chamber;

the rate control valve includes a control surface exposed to the second control chamber; and the injection rate controller further includes a control valve assembly coupled with the electrical actuator and movable to open and block the second control chamber to the low pressure outlet.

16. The fuel injector of claim 12 wherein the at least one body piece includes a metering edge, and the rate control valve has an outer surface movable relative to the metering edge.

17. The fuel injector of claim 16 wherein the rate control valve is movable between a first stop position where a relatively smaller clearance extends between the metering edge and the outer surface, and a second stop position where a relatively larger clearance extends between the metering edge and the outer surface.

18. A method of operating a pressurized fuel injection system comprising:

conveying a pressurized fuel from a common rail into a fuel injector;

opening an outlet check in the fuel injector to start an injection of the pressurized fuel from the fuel injector into a cylinder in an internal combustion engine;

adjusting an injection rate controller within the fuel injector between a rate limiting configuration and a second configuration after the start of the injection of the pressurized fuel to vary a pressure drop through a nozzle passage of the fuel injector; and varying a rate of the injection of the fuel in response to the adjustment of the injection rate controller.

19. The method of claim 18 wherein the adjusting of the injection rate controller includes moving a rate control valve from a first position to a second position in opposition to a biasing force.

20. The method of claim 19 wherein the moving of the rate control valve further includes moving the rate control valve in response to adjustment of a position of a control valve in a control valve assembly of the injection rate controller.

* * * * *